United States Patent [19]

Bubley

[11] 4,216,591

[45] Aug. 12, 1980

[54] DRYER FOR PRINTED MATERIAL

[75] Inventor: Henry J. Bubley, Deerfield, Ill.

[73] Assignee: American Screen Printing Equipment Co., Chicago, Ill.

[21] Appl. No.: 964,491

[22] Filed: Nov. 29, 1978

[51] Int. Cl.[3] ..... F26B 7/00

[52] U.S. Cl. ..... 34/18; 34/68; 427/282; 427/381

[58] Field of Search ..... 34/4, 16, 18, 23, 30, 34/34, 41, 155, 160, 224, 225, 68; 427/282, 379, 381, 382

[56] References Cited

U.S. PATENT DOCUMENTS

| | | | |
|---|---|---|---|
| 2,083,423 | 6/1937 | Bennett, Jr. | 427/381 X |
| 2,306,019 | 12/1942 | Hanson | 34/160 |
| 2,384,990 | 9/1945 | French | 34/18 X |
| 2,731,732 | 1/1956 | Harris, Jr. et al. | 34/18 |
| 2,907,118 | 10/1959 | Maescher | 34/155 |
| 3,328,895 | 7/1967 | Krone et al. | 34/68 |
| 3,744,963 | 7/1973 | Flynn | 34/155 X |

FOREIGN PATENT DOCUMENTS

| | | | |
|---|---|---|---|
| 1114148 | 9/1961 | Fed. Rep. of Germany | 34/155 |
| 736656 | 12/1932 | France | 34/160 |
| 287956 | 12/1952 | Switzerland | 34/68 |
| 978704 | 12/1964 | United Kingdom | 34/4 |

*Primary Examiner*—Albert J. Makay
*Assistant Examiner*—Harold Joyce
*Attorney, Agent, or Firm*—Neal J. Mosely

[57] ABSTRACT

Printing material, particularly textile material, imprinted with solvent- or water-based heat curable printing ink, or with a plastisol ink, is dried and the ink cured by first subjecting the imprinted stock to high velocity jets of temperature-controlled heated air until the solvent or water is substantially removed therefrom, and then, while the stock is still warm, moving the same to another position and further heating the imprinted stock by radiant heat for time sufficient to cure the ink imprint or design thereon.

12 Claims, 3 Drawing Figures

DRYER FOR PRINTED MATERIAL

BACKGROUND OF THE INVENTION

1. Field of the Invention

This invention relates to new and useful improvements in methods of drying imprinted stock or material, particularly textile material, and the apparatus for carrying out such printing methods. The invention is particularly concerned with providing a novel continuous dryer for drying textiles and other stocks or materials printed with solvent-based or water-based or plastisol printing inks, and particularly inks applied by screen printing.

2. Brief Description of the Prior Art

Textile materials, particularly tee shirts and the like, are commonly printed by screen printing or other printing techniques. These printing methods utilize solvent-based inks and water-based inks which require evaporation of the solvent or water portion of the ink prior to the final curing of the ink imprint to provide washability.

Dryers which are commercially available for drying screen printed textile materials usually have a continuously operating conveyor which moves imprinted materials through a heated chamber where the ink imprint or design is dried. Dryers for screen printed stock usually had radiant heating panels for evaporating the solvents and providing the heat required to effect a final cure of the imprinted ink or design.

A serious problem had existed in the curing of imprinted textiles in that the use of radiant panels in the drying operation has been ineffective as a high speed drying and curing process since the application of sufficient radiant heat to dry and cure the printing ink almost always results in a tendency toward scorching the textile fabric if precise control of the time-temperature relationship is not maintained. Further, attempts to dry and cure with heated air alone have failed due to difficulty and costs associated with systems that attempt to raise air temperatures high enough to effect both the drying of solvent and the final cure of the imprinted ink. Such systems have required longer equipment and are substantially more expensive. There has therefore been a vital need for a high speed continuous dryer for printed textiles which will dry and cure the ink imprint or design quickly on the textile material without scorching it.

SUMMARY OF THE INVENTION

This invention comprises a new and improved continuous dryer for textiles printed with heat curable printing inks and plastisol inks. The dryer includes an elongated housing having openings at opposite ends with rollers and supports for a conveyor belt positioned outside said openings. The conveyor belt supported on said rollers and said supports is positioned for movement longitudinally through said housing. The housing is divided by a wall into first and second drying chambers. The first drying chamber includes a plurality of V-shaped cross section air knives positioned for impinging continuous jets of air onto textile stock or material carried on the conveyor belt. A blower is provided to circulate the air and heaters are provided to heat the air to a temperature sufficient to remove the solvent or water from the printing ink. A second blower is provided in the lower part of this chamber to exhaust air to prevent buildup of solvent in the air being recirculated.

The blowers are effective to maintain a slight subatmospheric pressure or vacuum below the conveyor belt to hold the textile stock or material on the belt. The second chamber is provided with one or more radiant heaters which provides the necessary heat to cure the ink imprint or design on the textile stock carried by the conveyor belt.

DESCRIPTION OF THE PREFERRED EMBODIMENT

Figure 1:
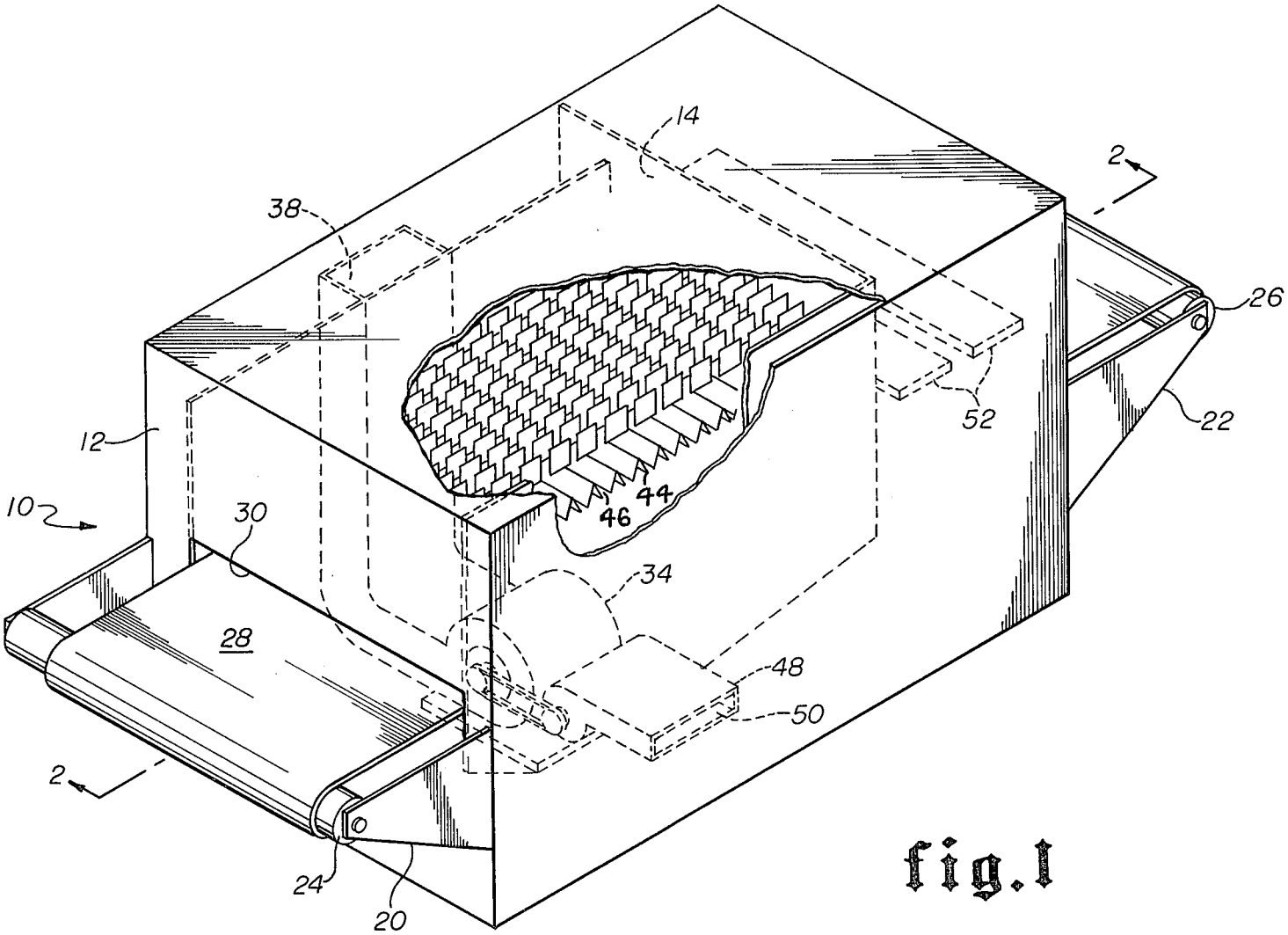
FIG. 1 is a diagrammatic isometric view of a preferred embodiment of this dryer.

In the drawings, the improved dryer 10 consists of an elongated housing 12 having vertically extending interior wall 14 dividing the interior of the housing 10 into a first drying chamber 16 and second drying chamber 18. Housing 12 is provided with supports 20 and 22 at opposite ends which support rollers 24 and 26 for continuous conveyor belt 28. The dryer is preferably provided with an electric motor or the like (not shown) for driving roller 26 in a clockwise direction, as shown. Housing 12 is also provided with openings 30 and 32, at opposite ends thereof, which permit continuous movement of conveyor belt 28 therethrough. Conveyor belt 28 is preferably a continuous woven open mesh (for free flow of air therethrough) material which is relatively insensitive to heat. A suitable conveyor belt for this purpose is of a plastic-coated fiberglass material having an open mesh.

Figure 3:
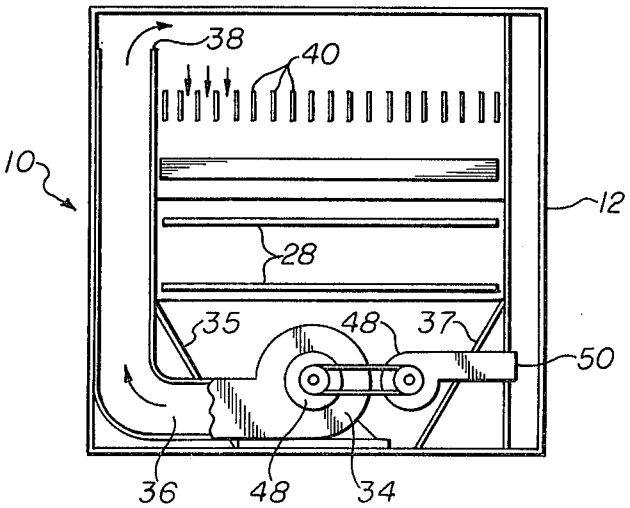
FIG. 3 is a diagrammatic view of the dryer as seen on the section line 3—3 of FIG. 2.

In the bottom of chamber 16 in the dryer, below conveyor belt 28, there is positioned an air circulating blower 34 which is preferably adjustable either by varying the speed of the blower motor 49 or by other suitable adjustments of the air delivery system. In FIG. 3, it is seen that blower 34 is positioned to discharge air into duct 36 which extends up the side of chamber 16 and opens into the upper end of chamber 16 at opening 38.

Blower 34 draws air from the space in which it is positioned and maintains a slight vacuum (about $\frac{1}{8}$ in. of water) below conveyor belt 28 to assist in holding the textile printing stock or material thereon. Blower 34 continuously circulates air into the space above conveyor belt 26 and causes it to circulate over the printed material and through conveyor belt 28 back to blower 34. Bottom walls 31 and 33 (in FIG. 2) slope toward blower 34. Bottom side walls 35 and 37 (in FIG. 3) are similarly sloped toward blower 34. These sloping walls are a necessary design feature to insure proper recirculation of air to blower 34.

Figure 2:
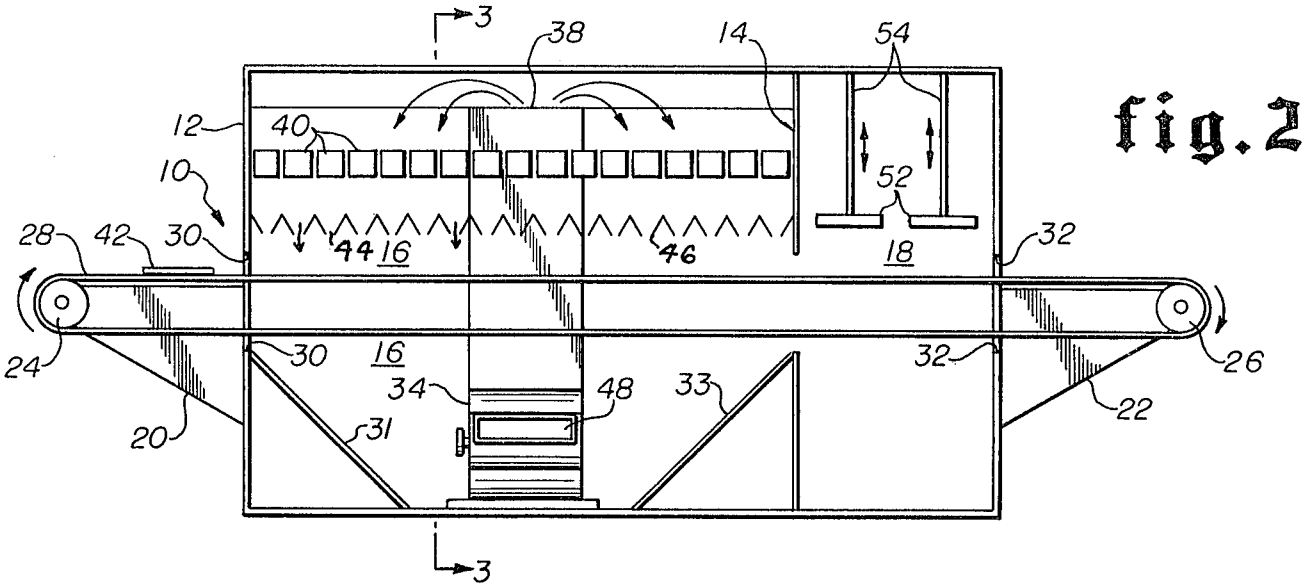
FIG. 2 is a diagrammatic view of the dryer as seen on the section line 2—2 of FIG. 1.

In the upper end of chamber 16 there is provided a suitable heating means, preferably an electric heating means 40, which is preferably a plurality of separate electrically controlled and energized heaters, as seen in FIGS. 2 and 3. The air which circulates through duct 36 and opening 38 passes over heaters 40 where it is heated to the desired temperature for drying the printed textile material 42 which is carried on conveyor belt 28 continuously through the dryer.

In the upper end portion of chamber 16 there are provided a plurality of air knives 44 through which the air is ejected at high velocity to impinge upon the printed textile material 42 and conveyor belt 28 , as indicated by the directional arrows in FIG. 2. Air knives 44 are of V-shaped cross-section and have their knife edge slots 46 extending laterally across conveyor belt 28. Air knives 44 are therefore operable to provide a plurality of narrow continuous jets of heated air extending across the width of conveyor belt 28 to wipe along the material being printed and thus facilitate rapid uniform drying of the solvent or water from the printing ink on the material carried by conveyor belt 28.

In bottom portion of chamber 16 of dryer 10, there is provided a second blower 48 which is positioned with its exhaust 50 opening outside housing 12. Blower 48 is operable to exhaust part of the air circulating through chamber 16 to prevent buildup of solvent in the circulating air. Blowers 34 and 48 are preferably driven by a common motor 49. As noted above, blowers 34 and 48, maintain a sub-atmospheric pressure in the portion of chamber 16 below conveyor belt 28. This maintains a sufficient pressure differential across conveyor belt 28 to hold the material being printed positively thereon.

In the second chamber 18 of housing 12 there are provided one or more radiant heaters 52 which are adjustably supported as indicated at 54. Radiant heaters 52 may be electrically energized or gas-fired and effect the final cure of the printed ink on the textile stock or material 42 after the solvent or water has been removed in the first drying chamber 16.

OPERATION

While the operation of this improved dryer is readily understood from the foregoing description of its assembly and construction, a further description of operation will be given for purposes of clarification and indicating preferred operating conditions.

The dryer described above is preferably for the drying of textile stock or material which has been screen printed with solvent- or water-based printing inks or plastisol printing inks. The textile or other printing material 42 is placed on conveyor belt 28 for continuous movement through the dryer. Conveyor belt 28 moves material 42 into the first drying chamber 16. Drying chamber 16 is preferably about 60–70% of the length of the dryer while drying chamber 18 is preferably about 30–40% of the length of the dryer. In drying chamber 16, the heated air which is circulated by blower 34 through air knives 44 is impinged upon textile material 42 to dry out solvent or water from the printed ink. In this section of the dryer, heaters 40, which are preferably electric heaters, are contollable to heat the circulating air to a temperature ranging from ambient to 350° F. (or higher if needed). In a typical operation of the dryer using textile stock or material 42 printed with solvent-base inks, the circulating air would be maintained at a temperature of about 300°–350° F. with the air knives 44 positioned with their discharge slots 46 about 2 inches above the textile material being printed. The circulation of air by blower 34 preferably maintains a pressure of about one and on-half to two inches of water in the portion of chamber 16 above air knives 44 and maintains a slight vacuum (approximately $\frac{1}{8}$ inch of water) below conveyor belt 28 (sufficient to hold the textile material being printed thereon). Blower 34 is operated at a speed to effect 50 or more changes of air (preferably 80–100 air changes) per minute through the upper portion of chamber 16. There is no practical upper limit on the air speed. In the bottom of chamber 16, a separate blower 48 is operated to exhaust sufficient air to prevent buildup of solvent in the recirculating air. These operating conditions are adequate to remove the solvent or water from a solvent- or water-based printing ink on printed textile material 42 while the material is moved the length of dryer chamber 16.

When printed textile material 42 moves into dryer chamber 18 the solvent or water has been substantially completely removed from the imprint or design but the ink has not yet been fully cured. The radiant heating (infra-red) panels 52 are preferably electrically heated (but may be gassed fired) and preferably controllable in the temperature range from about 600° to 1100° F. A temperature of 900° F. is preferred for many drying applications. The radiant heating panels 52 are supported adjustably as indicated at 54 and preferably positioned in the range from about 4 to 6 inches above conveyor belt 28. These heating panels are adequate to heat printing ink on textile material 42 to a temperature sufficient to cure the printing ink (after the solvent or water has been removed in the first drying chamber 16) without scorching the textile material.

The conditions which have been given above are suitable for the drying of solvent- or water-based printing inks on cotton fabrics or for curing plastisol inks. Obviously, the conditions can be varied, as needed, for other textile material or for other printing stock of other types of printing inks.

While this invention has been described with special emphasis upon a single preferred embodiment, it will be obvious to those skilled in the art that variations in the apparatus and in the process of drying may be used and it is intended that within the scope of the claims the invention may be practiced otherwise than as specifically described herein.

I claim:

1. A two-step method of drying and curing a water- or solvent-based printing ink screen printed on dry stock or material which comprises, impinging high velocity jets of heated air, at a temperature from ambient to about 350° F., against the ink imprint on said imprinted stock or material until the water or solvent is substantially removed from said imprint and said ink imprint is heated to an elevated temperature, moving said stock or material to another position and, while said ink imprint is still warm, heating said ink imprint on said stock or material by radiant heat to a predetermined higher temperature for a time sufficient to cure said ink imprint without scorching said stock or material.

2. A method according to claim 1 in which said heated air is recirculated and a portion of said heated air is exhausted and replaced to prevent buildup of solvent or water therein.

3. A two-step method of drying and curing printing ink on dry textile or other stock or material screen printed thereon with heat-curable evaporative inks or heat-fusible printing inks comprising moving said stock or material on a continuously movable conveyor belt into a first drying chamber, circulating heated air in said first chamber in high velocity jets against said conveyor belt and the stock or other material carried thereon at an air temperature, from ambient to about 350° F., sufficient to remove solvent or water from the ink screen imprint on the textile material and elevate the temperature of said ink, replacing a portion of said circulating air to prevent buildup of solvent herein, and moving said stock or material on said conveyor belt into a second drying chamber immediately adjacent to said first drying chamber and subjecting the same to radiant heating to raise the temperature of the imprint to a predetermined higher temperature for a time sufficient to effect a cure or fusion of the printing ink on said imprinted material after removal of the solvent or water therefrom without scorching said stock or material.

4. A method according to claim 3 in which said step of air circulating in high velocity jets comprises circulating air by an air circulating blower through a plurality of air knives positioned to impinge high velocity air streams on the ink screen imprint on the material carried on said conveyor belt.

5. A method according to claim 4 in which said step of air circulating is through air knives of V-shaped cross-section with the slot of each air knife extending laterally along said conveyor belt.

6. A method according to claim 4 in which said step of air circulating is by a blower positioned below said conveyor belt and delivering air to the space above said air knives for delivery of air therethrough to impinge the ink imprint on the stock or material carried on said conveyor belt.

7. A method according to claim 3 including heating said air by electric heating means.

8. A method according to claim 3 in which said step of moving said stock or material is by a moving conveyor belt comprising an endless fabric belt having low sensitivity to heat and an open mesh allowing free passage of air therethrough.

9. A method according to claim 3 including the step of maintaining the space below said conveyor belt at a subatmospheric pressure to hold screen printed textile material or stock on said belt during drying.

10. A method according to claim 3 in which said step of radiant heating is effected by electrically energized infrared heaters.

11. A method according to claim 3 which includes the steps of varying said air circulation and said air heating to control the volume and temperature of circulating air, and adjusting said radiant heating to vary the heat supply to the ink imprint on the stock or material on said conveyor belt in said drying chamber.

12. A method according to claim 1 or 3 in which said radiant heating step is by heaters maintained at a temperature of about 600°–1100° F.

* * * * *